US011649628B2

(12) United States Patent
Ek

(10) Patent No.: US 11,649,628 B2
(45) Date of Patent: May 16, 2023

(54) AREA SEPARATION FIREWALL SYSTEM

(71) Applicant: EAGLE MATERIALS IP LLC, Dallas, TX (US)

(72) Inventor: Robert Ek, Wylie, TX (US)

(73) Assignee: EAGLE MATERIALS IP LLC, Dallas, TX (US)

( * ) Notice: Subject to any disclaimer, the term of this patent is extended or adjusted under 35 U.S.C. 154(b) by 0 days.

(21) Appl. No.: 17/649,869

(22) Filed: Feb. 3, 2022

(65) Prior Publication Data

US 2023/0113115 A1 Apr. 13, 2023

Related U.S. Application Data

(60) Provisional application No. 63/262,268, filed on Oct. 8, 2021.

(51) Int. Cl.
*E04B 1/94* (2006.01)
*E04B 2/58* (2006.01)

(52) U.S. Cl.
CPC ..... *E04B 1/945* (2013.01); *E04B 2/58* (2013.01)

(58) Field of Classification Search
CPC ..... E04B 1/945; E04B 2/58
USPC ..... 52/407.3
See application file for complete search history.

(56) References Cited

U.S. PATENT DOCUMENTS 2,815,542 A * 12/1957 Baker ..... E04B 2/7401 52/783.1
2,884,779 A * 5/1959 Buergin ..... E04C 2/043 52/592.1
3,312,019 A * 4/1967 Faerber ..... E04B 2/58 52/282.4
3,707,818 A * 1/1973 Nelsson ..... E04B 2/60 52/220.1
3,810,335 A * 5/1974 McCrillis ..... E04B 1/348 52/236.9
3,839,839 A * 10/1974 Tillisch ..... E04B 2/74 52/855
3,876,147 A * 4/1975 Aris ..... E04B 1/945 169/54
3,974,607 A * 8/1976 Balinski ..... E04B 1/941 52/794.1
4,152,878 A * 5/1979 Balinski ..... E04B 1/941 52/772
4,161,087 A * 7/1979 Levesque ..... E04B 1/14 52/407.3
4,292,364 A * 9/1981 Wesch ..... B32B 13/12 428/688
4,306,396 A * 12/1981 Iotti ..... E04B 2/7411 52/266
4,869,037 A * 9/1989 Murphy ..... E04B 1/642 52/748.11
4,881,352 A * 11/1989 Glockenstein ..... E04B 2/821 52/239

(Continued)

*Primary Examiner* — Brian D Mattei
*Assistant Examiner* — Joseph J. Sadlon
(74) *Attorney, Agent, or Firm* — Haynes and Boone, LLP

(57) ABSTRACT

A firewall includes wallboard arranged in three or more layers. The wallboard may include gypsum, fiber glass, and/or vermiculite. The firewall may be reinforced with fasteners, such as laminating screws, affixing the layers of wallboard to one another. The firewall may be incorporated into an area separation wall such that the area separation wall satisfies the standards of ASTM E119 or UL 263.

16 Claims, 10 Drawing Sheets

(56) References Cited

U.S. PATENT DOCUMENTS 5,081,810 A * 1/1992 Emmert ..... E04C 2/36 52/794.1
5,167,098 A * 12/1992 Blackwelder ..... E04H 5/02 52/263
5,655,350 A * 8/1997 Patton ..... E04B 1/7604 52/404.1
5,661,273 A * 8/1997 Bergiadis ..... E01F 8/0029 181/290
5,749,187 A * 5/1998 Umehara ..... E04B 2/7409 52/407.3
5,822,935 A * 10/1998 Mitchell ..... E04B 2/7455 52/475.1
5,950,385 A * 9/1999 Herren ..... E04F 17/005 52/489.1
6,182,407 B1 * 2/2001 Turpin ..... E04B 1/942 52/784.11
6,481,172 B1 * 11/2002 Porter ..... B32B 5/18 52/794.1
6,588,172 B2 * 7/2003 Porter ..... E04C 2/296 52/794.1
7,849,650 B2 * 12/2010 Tonyan ..... B32B 13/02 106/735
7,946,384 B2 * 5/2011 Foster ..... E04B 2/7457 52/698
8,065,852 B2 * 11/2011 Tonyan ..... B28B 1/522 428/192
8,448,406 B2 * 5/2013 Shepard ..... E04B 1/10 52/262
8,549,806 B2 * 10/2013 Snyder ..... E04F 19/061 52/302.1
8,756,889 B2 * 6/2014 LeBlang ..... E04B 1/80 52/309.4
8,789,341 B2 * 7/2014 Shepard ..... E04C 3/16 52/262
9,133,617 B2 * 9/2015 Green ..... B32B 15/04
9,422,714 B2 * 8/2016 Miller ..... E04B 1/945
9,593,044 B2 * 3/2017 Moore ..... E04C 2/06
9,676,168 B2 * 6/2017 Contzen ..... B32B 5/022
9,938,192 B2 * 4/2018 Moore ..... C04B 24/383
9,963,884 B1 * 5/2018 Clemens ..... C04B 24/383
10,000,923 B2 * 6/2018 Pilz ..... E04B 2/7409
10,066,390 B2 * 9/2018 Pospisil ..... E04B 1/24
10,179,992 B2 * 1/2019 Brekke ..... E04B 1/2612
10,179,997 B2 * 1/2019 Thomas ..... B32B 9/007
10,240,341 B2 * 3/2019 Dettbarn ..... E04B 1/944
10,487,497 B1 * 11/2019 Aitken ..... E04F 13/14
10,626,598 B2 * 4/2020 Klein ..... B32B 9/007
10,689,846 B2 * 6/2020 Ullett ..... E04F 17/005
2007/0101678 A1 * 5/2007 Miniter ..... E04C 2/34 52/782.1
2008/0086957 A1 * 4/2008 Averill ..... B32B 13/08 52/745.19
2008/0236943 A1 * 10/2008 Zickell ..... E04B 1/8409 181/294
2011/0047889 A1 * 3/2011 Gad ..... E04H 1/005 52/650.1
2011/0271619 A1 * 11/2011 Nelson ..... E04B 2/7457 52/698
2018/0119417 A1 * 5/2018 Li ..... C04B 28/14
2020/0139674 A1 * 5/2020 Donelan ..... B32B 15/18
2020/0299956 A1 * 9/2020 Chatani ..... B32B 1/08
2021/0396006 A1 * 12/2021 Collins ..... B32B 15/18

* cited by examiner

AREA SEPARATION FIREWALL SYSTEM

CROSS-REFERENCE TO RELATED APPLICATIONS

The present application claims benefit of U.S. Provisional Patent Application No. 63/262,268 filed Oct. 8, 2021, titled "AREA SEPARATION FIREWALL SYSTEM," which is incorporated herein by reference in its entirety.

FIELD OF THE DISCLOSURE

The present disclosure relates to area separation firewalls. More particularly, the disclosure relates to an improved firewall for use in area separation firewall systems, with this system including wider, thinner pieces of gypsum wallboard that are easier to manufacture and install as compared to traditional 1" thick shaft liner wallboard.

BACKGROUND

International, state, regional and local building codes require that multi-family residential buildings include certain fire protection features, such as firewalls between residential units. The standard for qualifying fire rated systems is either ASTM E119 ("Standard Test Methods for Fire Tests of Building Construction and Materials") or ANSI/UL 263 test ("the Standard for Safety of Fire Tests of Building Construction Materials"). During this testing, an area separation firewall system therein is heated to 1000° F. and then ramped to 2000° F. The firewall must be able to resist this heat for a specified period of time, such as two hours. Another aspect of this testing is a hose stream test, wherein a pressurized stream of water is directed at the vertical fire resistive wall assembly after fire endurance exposure simulating a fire being extinguished. The vertical firewall must be able to maintain its structural integrity, and not allow water to pass through it.

For decades, multi-family residential firewalls have been constructed with two pieces of 1" thick shaft liner wallboard. These wallboard panels are particularly difficult to manufacture and typically slows production by a factor of two or more. These thick pieces of wallboard are also cumbersome and only 2' wide—as compared with a 4' width for other wallboard panels—in order to manage the weight thereof. This decreased width translates to added materials and labor when installing the firewall, since the 2 pieces of shaft liner wallboard must be joined with the next section using a metal H-Stud. Despite the long tenure of these firewalls, little improvement has been made to the conventional design. As such, there remains a great need for an improved firewall wallboard that can be efficiently manufactured and installed.

BRIEF DESCRIPTION OF THE DRAWINGS

Various embodiments of the present disclosure will be understood more fully from the detailed description given below and from the accompanying drawings. In the drawings, like reference numbers may indicate identical or functionally similar elements. Embodiments are described in detail hereinafter with reference to the accompanying figures, in which.

DETAILED DESCRIPTION

Figure 1:
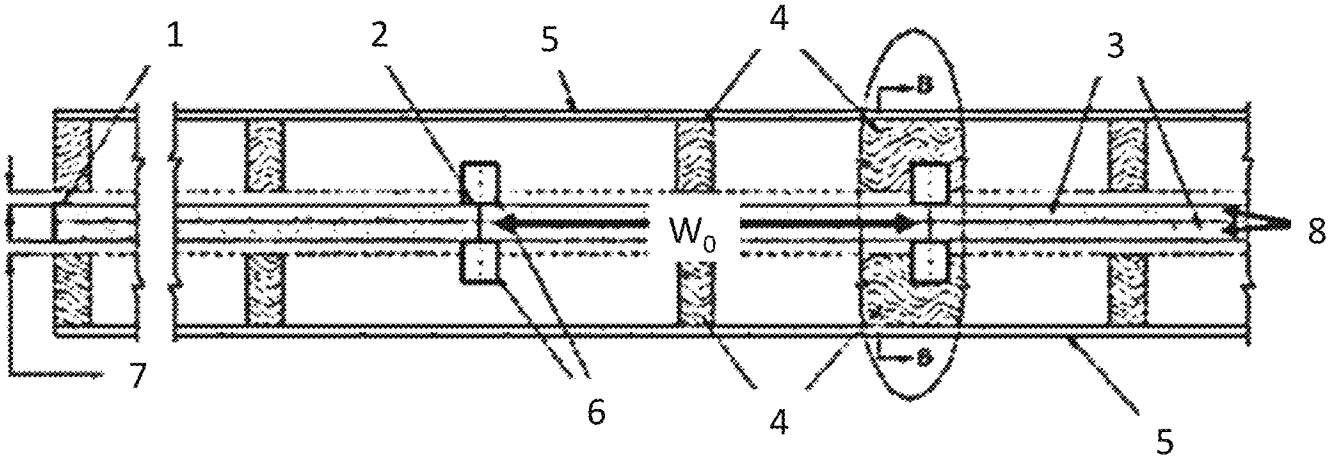
FIG. 1 (PRIOR ART)
FIG. 1 is a top view of a prior art area separation firewall.

The following disclosure provides many different embodiments or examples. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a top view of a conventional 2-hour area separation firewall. The area separation firewall includes a pair of opposite interior walls 5 each supported on a series of studs 4, which are typically made of wood. Between the interior walls 5 is a firewall 8 spaced from the studs 4 by an airgap 7, which may be about ¾". The firewall 8 includes two-wallboard-thick panels comprising two, 1" thick wallboards 3. Each wallboard 3 may have a width $W_0$ of about 2'. The panels of the firewall 8 are joined together by H-studs 2 and an end panel of the firewall 8 is capped with a C-stud 1. The C-studs 1 and H-studs 2 may be made of metal, such as steel. The H-studs are fixed to wood framing via clips 6, which are typically made from aluminum and configured to break away if the wood framing collapses in a fire thereby leaving the firewall 8 standing.

Figure 2:
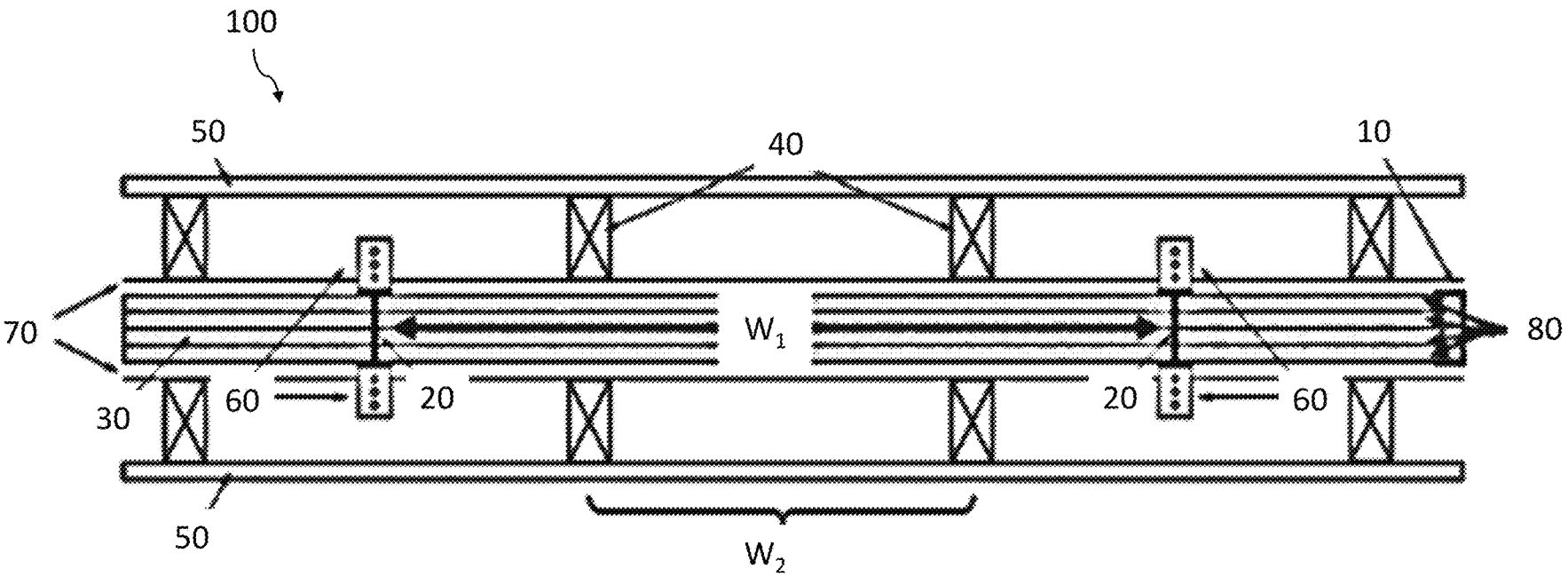
FIG. 2 is a top view of an area separation firewall according to an embodiment of the present disclosure.

FIG. 2 is a top view of a 2-hour area separation firewall 100 according to an embodiment of the present disclosure. The area separation firewall 100 includes a pair of opposite interior walls 50 each supported on a series of studs (framing) 40, which are typically made of wood or metal. The studs 40 are separated by a maximum distance $W_2$ of about 2'. Between the interior walls 50 is a firewall 80 spaced from the studs 40 by an airgap 70 of a minimum of ¾". The firewall 80 includes four-wallboard-thick panels comprising four wallboards 30 each having a nominal thickness of, e.g., less than 1" or about 0.5". Accordingly, the firewall 80 may be about as thick as a traditional firewall having two 1" thick pieces of wallboard. Each wallboard 30 may have a width $W_1$ of about 2', greater than 2', about 3', about 3.5', about 4', greater than 4', about 54", or at most 54". The increased width of the wallboards 30 is made possible due to the thinner profile, whereby the wallboards 30 may be about as heavy as traditional firewall wallboards. The panels of the firewall 80 are joined together by H-studs 20 and an end panel of the firewall 80 is capped with a C-stud 10, such as a 2" C-stud. The firewall 80 may be friction fit into each of the C-studs 10 and H-studs 20. The H-studs 20 and/or C-studs 10 may be attached to the wood framing 40 with aluminum clips 60. In some embodiments, the clips 60 are made from aluminum and designed to melt or break away if the wood framing 40 collapses in a fire thereby leaving the firewall 80 standing.

In any embodiment, the material used for the wallboard 30 is typically more fire resistant than that used for the interior walls 50. In some embodiments, the wallboard 30 may be comprised of gypsum, fiber glass, and vermiculite. In one or more embodiments, the wallboard 30 comprises one or more of a dispersant, a fire retardant (retarder), a chelating agent, a soap, a binder or adhesive, an accelerator, a surfactant, an acid, a stabilizing agent, and/or a foaming agent. In some embodiments, the dispersant may include polynaphthalene sulfonate in a sodium or calcium salt solution (having 2-80% solids content). In some embodiments, the binder or adhesive may include starch, such as acid-modified corn starch (AMCS) or pre-gelatinized corn starch. In some embodiments, the retarder or chelating agent may include pentasodium diethylenetriaminepentaacetate. In some embodiments, the acid may include boric acid. In some embodiments, the stabilizing agent is sodium trimetaphosphate (STMP). In some embodiments, the soap, surfactant, and/or foaming agent may include ammonium alkyl ether sulfate. In one embodiments, the wallboard may have the following formulation:

TABLE 1

| Component | Content (lbs./msf) |
|---|---|
| Retarder | 0.02-4.0 |
| Stucco | 1300-1700 |
| Soap | 1.0-7.0 |
| Starch | 3.0-12.0 |
| Vermiculite | 25.0-65.0 |
| Fiber glass | 3.0-16.0 |
| Core adhesive | 6.0-25.0 |
| Dispersing agent | 1.0-8.0 |
| Foaming agent | 0.01-5.0 |
| Boric acid | 0.02-5.0 |
| STMP | 1.50-9.0 |
| Accelerator | 6.0-15.0 |
| Average Weight | 1950-2100 |

In one or more embodiments, the wallboard 30 may be a commercially available wallboard from American Gypsum sold under the tradename M-BLOC® Ekcel™ TYPE X. In one or more embodiments, the wallboard 30 does not include asbestos and/or does not include detectable levels of formaldehyde. Since the firewall 80 is usually installed prior to the completion of the roof and exterior walls, the wallboards 30 may be exposed to the elements for a period of time. As such, in some embodiments, an exterior surface of the wallboard 30 may be wrapped in a mold and moisture resistant covering. In some embodiments, the mold and moisture resistant covering may be one that has scored at least a 8, 9 or 10 under the ASTM D3273 (Standard Test Method for Resistance to Growth of Mold on the Surface of Interior Coatings in an Environmental Chamber). In some embodiments, coverings, such as the mold and moisture resistance covering discussed above, may cover the face and back of the wallboard 30. In some embodiments, the coverings comprise a paper or a glass mat.

In some embodiments, the interior walls 50 may be formed from ½" or ⅝" thick gypsum board available from American Gypsum under the tradenames LIGHTROC® or CLASSICROC® or any other fire rated or non-fire rated wallboard panel.

Figure 3:
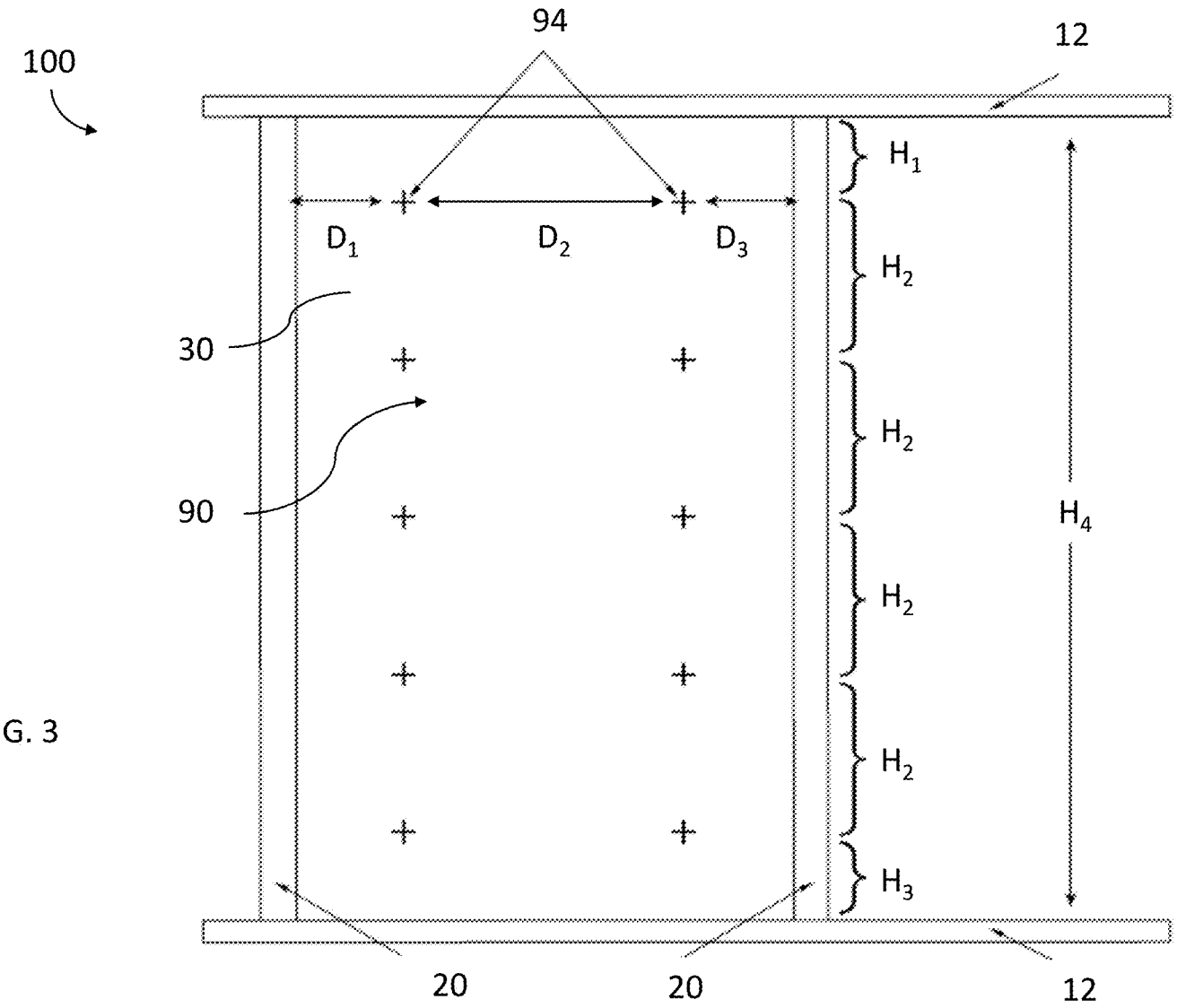
FIG. 3 is a side view of an area separation firewall according to an embodiment of the present disclosure.

Turning to FIG. 3, each four-wallboard-thick panel may be supported at the top and bottom thereof with a C-Runner channel 12. The pieces of wallboard 30 each have a height $H_4$ that corresponds to the height of the H-stud 20 in use. In some embodiments, the height $H_4$ may be up to 8', up to 10', up to 12', up to 14' or up to 16'. As will be described in more detail below, the area separation firewall 100 will typically extend through all floors of the building and therefore will have a height that is generally equivalent to the height of the building. In order to provide additional support to the wallboards 30, fasteners 94 may by installed to fasten the four layers of wallboard 30 to one another. In some embodiments, the fasteners 94 are nails, screws, or an adhesive. In some embodiments, the fasteners 94 are 1½" Type G laminating screws. In some embodiments, the fasteners 94 are long enough to penetrate through one, two, or three layers of wallboard 30. In some embodiments, the fasteners 94 are shorter than a thickness of the firewall 80 so that the fasteners 94 do not protrude out of the firewall 80. In some embodiments, the fasteners 94 are greater than ½ the thickness of the firewall 80 such that fasteners 94 installed on opposite sides of the firewall 80 are capable of laminating the layers of wallboard 30 to each other.

When the fasteners 94 are employed, they may be configured in a random assortment or they may be configured in a pattern 90. In the embodiment shown in FIG. 3, the fasteners 94 are equally spaced from each other within the pattern 90 and the pattern 90 is spaced from the edges of the wallboard 30. In particular, within the pattern 90, the fasteners 94 are spaced by a lateral distance $D_2$ and a vertical distance $H_2$. The distances $D_2$ and $H_2$ may be the same or different. In some embodiments, the distance $D_2$ is less than the distance $H_2$. In other embodiments, the distance $D_2$ is greater than the distance $H_2$. The pattern 90 is spaced from the vertical edges of the wallboard 30 by distances $D_1$ and $D_3$, which may be the same or different. In some embodiments, one or both of the distances $D_1$ and $D_3$ is the same as the distance $D_2$. The pattern 90 is spaced from horizontal edges of the wallboard 30 by distances $H_1$ and $H_3$, which may be the same or different. In some embodiments, the distances $D_1$, $D_2$, $D_3$, $H_1$, $H_2$, and $H_3$ are each independently from about 3" to about 36", from about 6" to about 24", from about 12" to about 30", from about 20" to about 36", about 16", about 24", or about 12".

Figure 4:
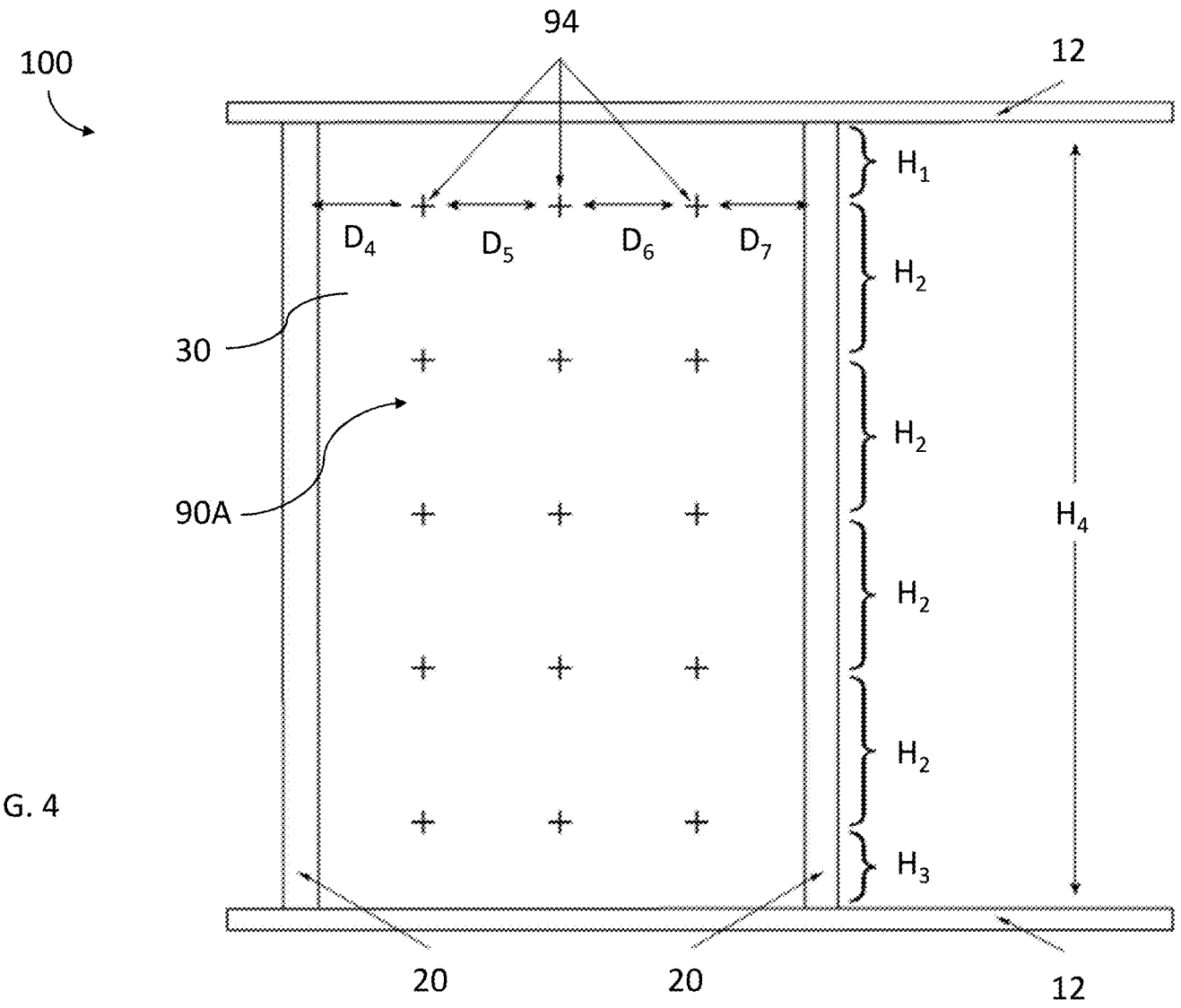
FIG. 4 is a side view of an area separation firewall according to another embodiment of the present disclosure.

With reference to FIG. 4, an alternative pattern 90A is shown. In FIG. 4, the pattern 90A is spaced from the edges of the wallboard 30 by distances $D_4$ and $D_7$, which may be the same or different from one another. The pattern 90A includes a middle column of fasteners 94 spaced from the outer columns of fasteners 94 by distances $D_5$ and $D_6$, which may be the same or different from one another. In some embodiments, the distances $D_4$, $D_5$, $D_6$, and $D_7$ are each independently from about 3" to about 36", from about 6" to about 24", from about 12" to about 30", from about 20" to about 36", about 16", about 24", or about 12".

Figure 5:
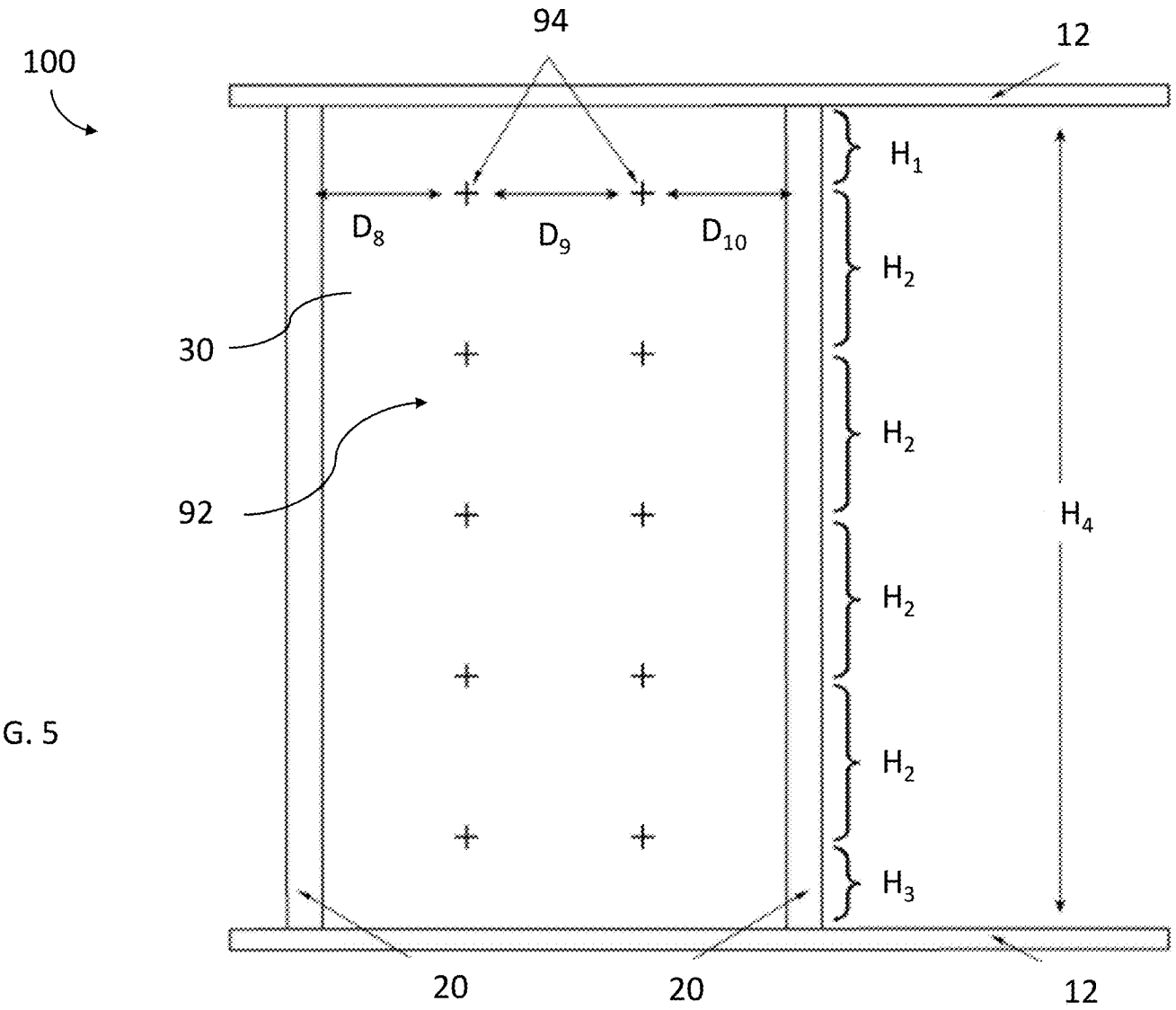
FIG. 5 is an opposite side view of the area separation firewall of FIG. 3 or FIG. 4.

Turning to FIG. 5, an opposite side of the wallboard 30 panel may also include a set of fasteners 94. In some embodiments, the fasteners 94 are arranged in a second pattern 92, which may be the same or different from the pattern 90. In FIG. 5, the pattern 92 is distinct from, but complementary to, the pattern 90. Arranging the fasteners 94 in this manner provides excellent structural support while conserving materials. The fasteners 94 are spaced from one another within the pattern 92 by a lateral distance $D_9$ and a vertical distance $H_2$. Although the embodiment shown includes the same vertical spacing for patterns 90 and 92, the respective vertical spacings may be, for example, offset by a distance of about 3", about 6", about 9", or about 12". In some embodiments, the distance $D_9$ is greater than the distance $D_2$. In other embodiments, the distance $D_9$ is less than the distance $D_2$. In yet other embodiments, the distance $D_9$ is equal to the distance $D_2$. The pattern 92 is spaced from the vertical edges of the wallboard 30 by distances $D_8$ and $D_{10}$, which may be the same or different. In some embodiments, one or both of the distances $D_8$ and $D_{10}$ is the same as the distance $D_9$. In some embodiments, the distances $D_8$, $D_9$, and $D_{10}$ are each independently from about 3" to about 36", from about 6" to about 24", from about 12" to about 30", from about 20" to about 36", about 16", about 24", or about 12". In an embodiment, the distance $D_1$ is about 12", the distance $D_2$ is about 24", the distance $D_3$ is about 12", the distance $D_4$ is about 12", the distance $D_5$ is about 12", the distance $D_6$ is about 12", the distance $D_7$ is about 12", the distance $D_8$ is about 16", the distance $D_9$ is about 16", the distance $D_{10}$ is about 16", the distance $H_1$ is about 12", the distance $H_2$ is about 24", the distance $H_3$ is about 12", and the distance $H_4$ is about 10'.

In any of the above embodiments, the fasteners 94 may be spaced such that any one fastener 94 has at least one adjacent fastener 94 within a set maximum distance. The at least one adjacent fastener 94 may be on the same side of the firewall 80 as the any one fastener 94 or may include fasteners 94 on the opposite side of the firewall 80. In some embodiments, the set maximum distance is from about 6" to about 24", about 8", about 12", about 14", about 16", about 18", about 20", about 22", or about 24".

Figure 6:
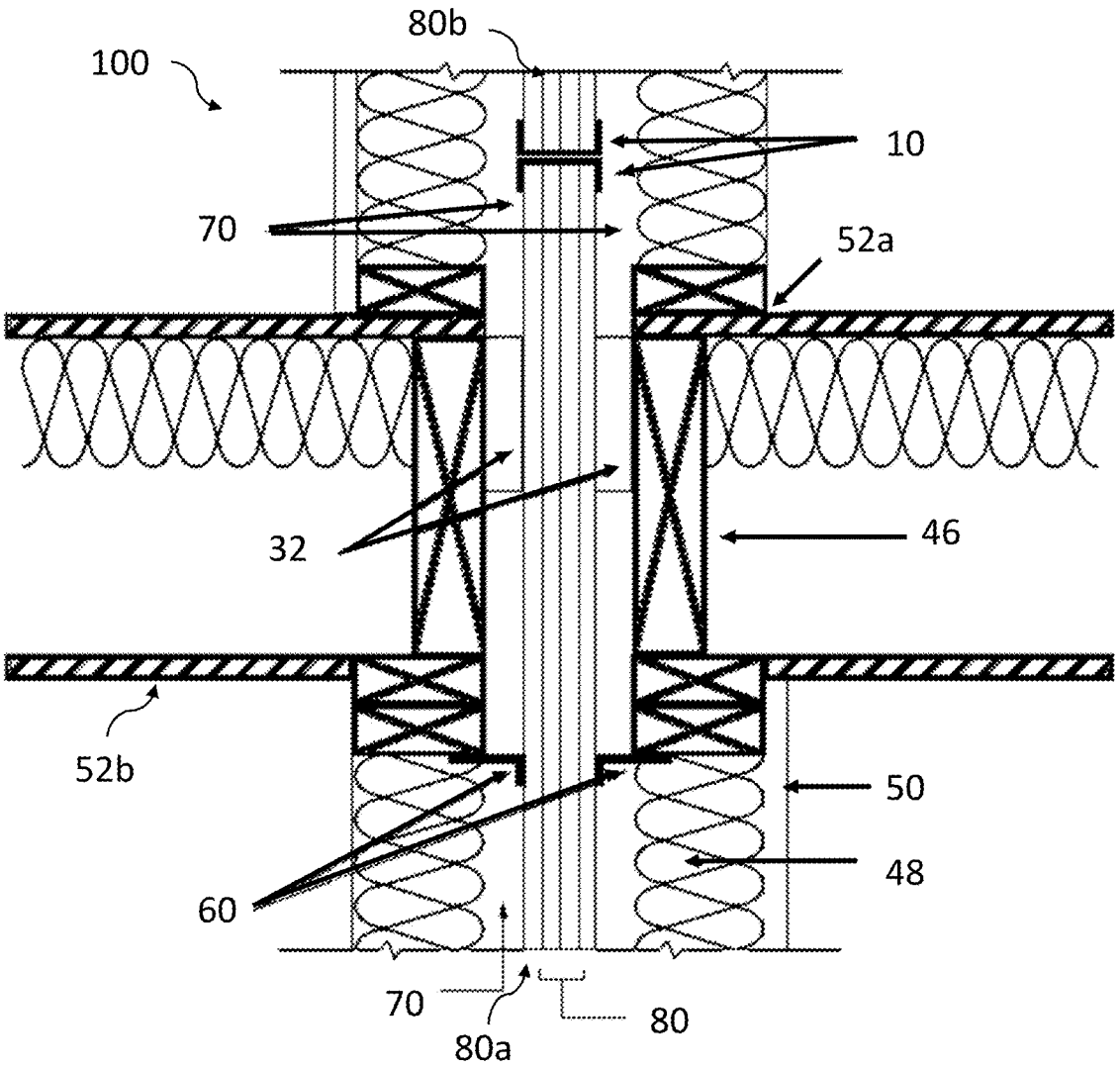
FIG. 6 is a cross-sectional side view of an area separation firewall within an intermediate floor intersection according to an embodiment of the present disclosure.

With reference to FIG. 6, in multi-level buildings, the area separation firewall 100 may need to traverse an intermediate floor junction. As shown, an airgap 70 is maintained along an entire length of the area separation firewall 100. In some embodiments, an additional fire blocking material 32 may be required proximate the floor joists 46. The fire blocking material 32 may comprise, for example, gypsum wallboard (such as that described for wallboard 30) or a mineral or glass fiber insulation. Insulation 48, such as glass fiber batt, may be placed as needed between the interior walls 50. Between levels 80*a* and 80*b* of the firewall 80, two C-studs 10 may be positioned back-to-back. Although the junction (at C-studs 10) between levels 80*a* and 80*b* is shown at a position above the upper floor 52*a*, the junction may be between the floor 52*a* and ceiling 52*b* or below the ceiling 52*b*. In some embodiments, caulk or another sealant may be used at the junction between C-studs 10 to create a smoke-tight joint.

Figure 7:
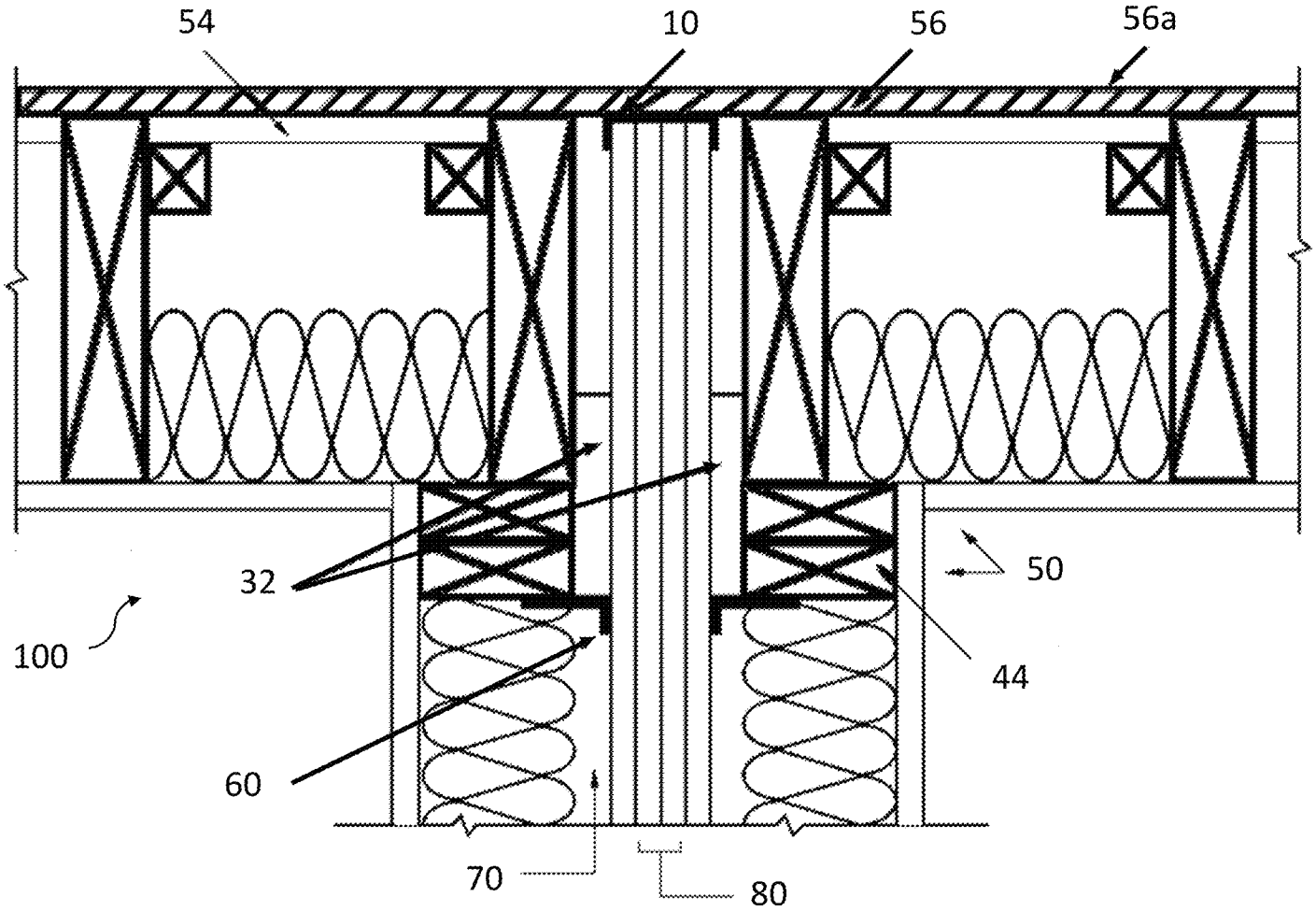
FIG. 7 is a cross-sectional side view of an area separation firewall at a roof junction according to an embodiment of the present disclosure.

Next, turning to FIG. 7, the area separation firewall 100 is shown at a junction with a roof deck 56. The roof deck 56 includes roofing 56*a*. In some embodiments, a layer 54 is needed below the roof deck 56, wherein the layer 54 may be, for example, a layer of wallboard such as that described above. In some embodiments, the layer 54 is about ⅝" thick. A C-stud 10 may cap the firewall 80 where it meets the roof deck 56. At this juncture, caulk or another sealant may be used to create a smoke-tight joint. In some embodiments, an additional fire blocking material 32 may be required proximate the framing 44 (including ceiling joists). The fire blocking material 32 may be as described above.

Figure 8:
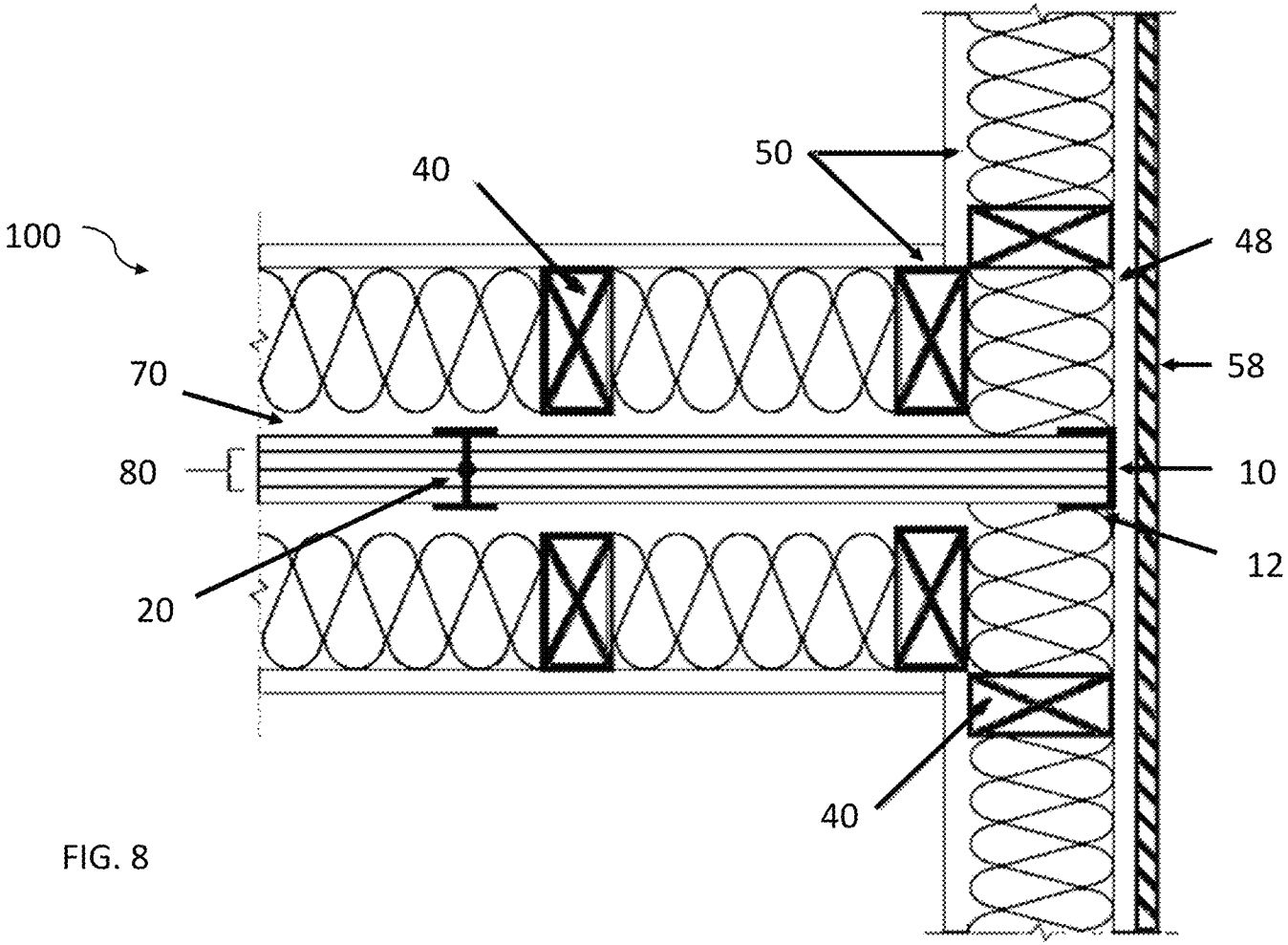
FIG. 8 is a cross-sectional top view of an area separation firewall at an exterior wall intersection according to an embodiment of the present disclosure.

With reference to FIG. 8, the area separation firewall 100 is shown at a junction with an exterior wall 58. In some embodiments, a sheathing layer 48 may be included inside of the exterior wall 58. In some embodiments, the sheathing layer 48 is about ⅝" thick. A C-stud 10 may cap the firewall 80 where it meets the sheathing layer 48 or the exterior wall 58. At this juncture, caulk or another sealant 12 may be used to create a smoke-tight joint.

Although the firewall 80 is described herein as comprising four pieces of wallboard 30, the firewall may include, for example, three, five, or six pieces of wallboard 30. In any embodiment, the thickness of the firewall 80 may be maintained at, for example, approximately 2" by appropriately adjusting the thickness of the wallboard 30. For example, three pieces of wallboard 30 may each have a thickness of about ⅔".

According to embodiments of the present disclosure, the firewall 80 may provide similar or improved fire protection as compared with conventional firewalls while significantly decreasing the cost of production and installation. As discussed above, conventional 1" thick, 2' wide wallboard can slow production by a factor of two or more. Conversely, the wallboard 30 disclosed herein does not cause such reduction of production. Additionally, even though four pieces of wallboard 30 are used for each panel (as compared to two in conventional firewalls) and fasteners 94 may be required, installation of the firewall 80 of the present disclosure is still faster than that of conventional firewalls. This is primarily because the wider pieces of wallboard 30 result in fewer H-studs 20 being required.

EXAMPLES

Example 1

Figure 9:
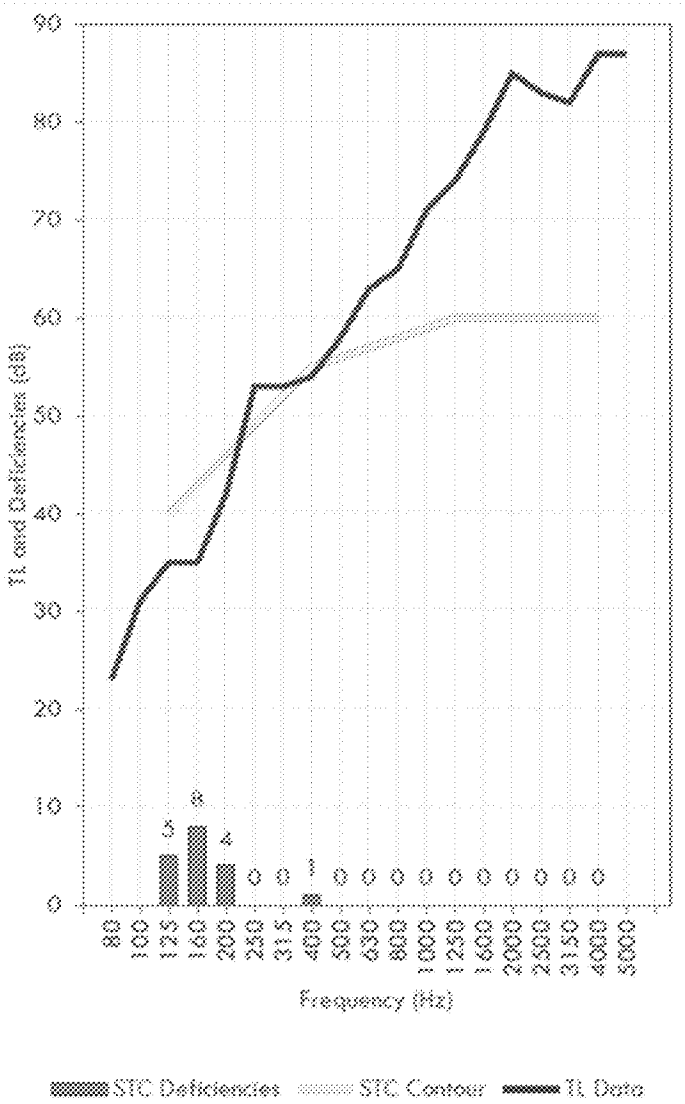
FIG. 9 is a graph showing the results of Example 1.

An area separation firewall generally as shown in FIG. 2 was assembled using four pieces of ½" thick wallboard for the firewall, type G laminating screws as fasteners for the wallboard, steel H-studs, steel C-studs, wood studs spaced at 16", glass fiber insulation batts friction fitted into cavities between the wood studs, and regular ½" thick gypsum wallboard secured to the wood studs for the interior walls. This assembly was then tested according to standard ASTM E90-09 (2016): Laboratory Measurement of Airborne Sound Transmission of Building Partitions and Elements. The results of this test are shown in FIG. 9, wherein the Sound Transmission Class (STC) contour is shown as a double line, the transmission loss (TL) is shown as a single line, and the STC deficiencies are shown as a bar graph. This test resulted in an STC rating of 56, which corresponds to the STC contour shown.

Example 2

Figure 10:
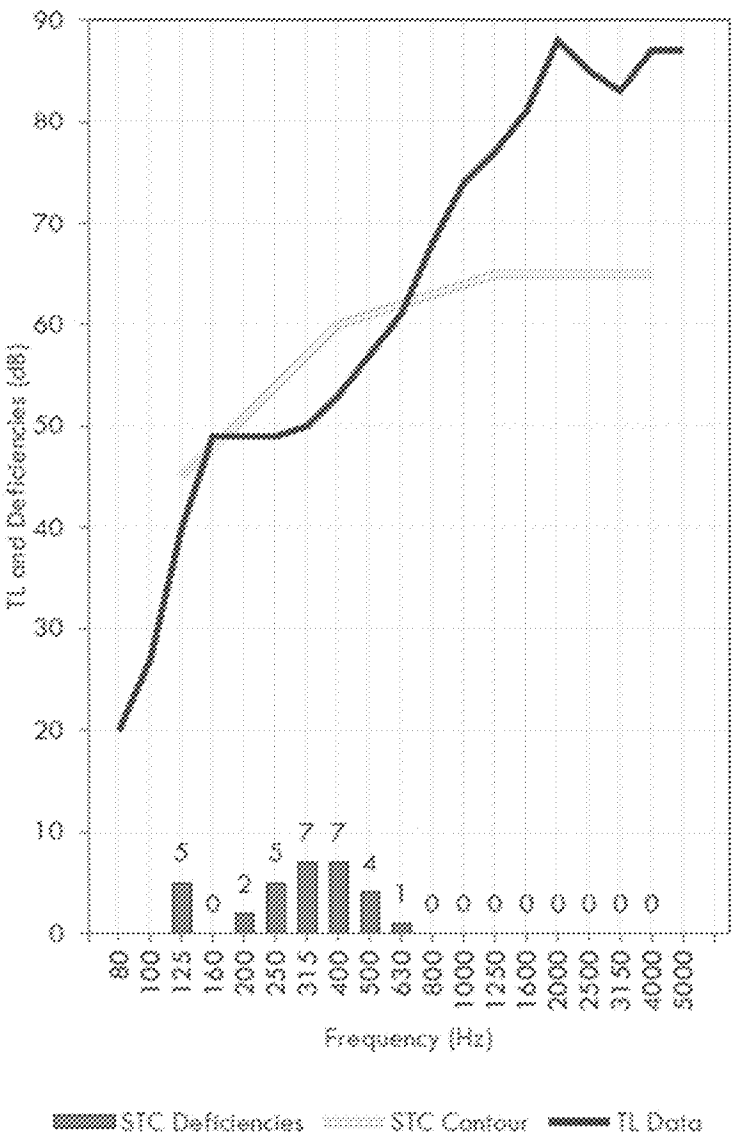
FIG. 10 is a graph showing the results of Example 2.

An area separation wall was assembled as described in Example 1, except that the wood studs were spaced at 24" o/c. This assembly was then tested according to standard ASTM E90-09 (2016). The results of this test are shown in FIG. 10. This test resulted in an STC rating of 61, which corresponds to the STC contour shown.

Example 3

An area separation wall was assembled as described in Example 2. This assembly was then tested according to standard, Fire Tests of Building Construction and Materials, UL 263 (ASTM E119), 14$^{th}$ Edition dated Aug. 5, 2021 and the Standard, Standard Methods of Fire Endurance Tests of Building Construction and Materials CAN/ULC-S101-14, Fifth Edition, dated Dec. 2, 2020. The observations during the fire test are summarized in Table 2 below.

TABLE 2

| Test Time, Min | Exposed (E) or Un-exposed (U) Surface | Observations |
|---|---|---|
| 0 | U | The measured velocity across the unexposed surface of the test assembly was 0 feet per second. |
| 0 | E&U | Gas on. |
| 5 | E | Entire exposed face has turned black. |
| 10 | E | Exposed side board has turned gray/white. Paper is burning away, core visible in various spots. |
| 17 | E | Exposed side board joints have started to open (less than½ in.). Upper most panel exhibiting cracks. |
| 22 | E | Upper most board joint has opened to about 1 in., wood studs are visible and flaming. Top and bottom boards showing cracks. |
| 26 | E | Stud pattern visible through boards. |
| 28 | E | Bottom board joint has opened to about 1 in. Crack in center of bottom board has grown. |
| 33 | E | Significant flaming at exposed board joints. No exposed side board fall off at this point. |
| 40 | E | Middle board engulfed in flame. Top board joint opened to more than 1 in. Top board showing significant waving. No board fall off at this time. |
| 46 | E | Middle exposed panel has fallen. Top and bottom still attached. |
| 48 | E | Middle north side of exposed panel had fallen. |
| 51 | E | Top exposed board still attached. Studs visible at center area and still intact. |
| 54 | E | Exposed side wood studs have fallen. ½ in. Wallboard paper is charring |
| 60 | E | Paper on wallboard had turned fully white. |
| 65 | E | H-studs showing rippling. |
| 70 | E | Wallboard showing rippling in center of assembly. |
| 95 | E | Majority of top panel of unclassified board (interior wallboard) has fallen. |
| 130 | E | Wallboard layers start to deflect further and pull away. |
| 135 | E | Second layer of wallboard, north side has fallen. First laye rof wallboard south side has fallen. |
| 145 | E | Down to third layer of wallboard both north and south side. |
| 159 | E&U | Gas off, assembly no longer maintained load. All framing and gypsum board except for the outer most unclassified layer and wood studs had fallen into the furnace. |

As shown above, the assembly met the requirements for a 2-1/2 hour (150 minutes) load bearing wall. The finish rating is defined as the time necessary to raise the average temperature measured on the face of the wood studs nearest the fire by 250° F. or the time required to raise the temperature on the wood studs by 325° F. at any point. The average temperature measured on the wood studs was 65° F. before the test. Therefore, the average limiting temperature was 315° F. and the individual limiting temperature was 390° F.

The limiting temperatures for the unexposed surfaces did not occur during the 159 min. test duration. The average limiting average temperature and individual limiting temperatures were 162° F. and 180° F., respectively, at 159 min.

No suspected hot spots developed during the test requiring the application of cotton waste or the roving thermocouple.

Next, a duplicate assembly was heated according to the above standards for 1 hour prior to a hose stream test. The observations during the heating are summarized in Table 3 below.

TABLE 3

| Test Time, Hr:Min | Exposed (E) or Unexposed (U) Surface | Observations |
|---|---|---|
| 0:00 | E/U | The measured velocity across the unexposed surface of the test assembly was 0 FPS. |
| 1:00 | E/U | No significant changes occurred. Gas off. |

The assembly was then subjected to the impact, cooling, and eroding action of a 30 psi water stream applied through a 1-1/8 in. diameter nozzle at a distance of 20 ft. for 2-1/2 min. During the hose stream test, no water penetrated through the 4 layers of ½" gypsum. boards that created the area separation wall. Also, no water penetrated beyond the unexposed surface during the 2-1/2 minute hose stream test. Instead, the assembly remained intact during the 2-1/2 minute hose stream test.

Although various embodiments have been shown and described, the disclosure is not limited to such embodiments and will be understood to include all modifications and variations as would be apparent to one of ordinary skill in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed is:

1. A firewall comprising:

three or more consecutive layers of wallboard, and a plurality of fasteners affixing the three or more layers of the wallboard to one another;

wherein each layer of the wallboard comprises gypsum;

wherein each layer of the wallboard comprises a moisture resistant covering on an exterior surface thereof;

wherein at least one fastener of the plurality of fasteners is spaced at least 6" from horizontal edges of the wallboard and at least 6" from vertical edges of the wallboard; and wherein the firewall satisfies requirements for a 2-hour load bearing wall under ASTM E119 or UL 263.

2. The firewall of claim 1, further comprising metal studs abutting one or more edges of the wallboard.

3. The firewall of claim 1, wherein each layer of the wallboard further comprises vermiculite and fiber glass.

4. The firewall of claim 1, wherein each of the three or more layers the of wallboard has a width of 24 to 54 inches and a height of 6 to 16 feet; and wherein the three or more layers of wallboard has a combined thickness of about 2 inches.

5. The firewall of claim 1, wherein the plurality of fasteners are laminating screws.

6. The firewall of claim 5, wherein the plurality of fasteners are located on opposite sides of the firewall and arranged at regular intervals.

7. The firewall of claim 5, wherein the plurality of fasteners are spaced from one another by a distance of 6 to 24 inches.

8. The firewall of claim 1, wherein each layer of the wallboard comprises gypsum containing stucco at 1300 to 1700 parts by weight, vermiculite at 25 to 65 parts by weight, and fiber glass at 3 to 16 parts by weight.

9. The firewall of claim 8, wherein each layer of the wallboard further comprises an adhesive at 6 to 25 parts by weight, a foaming agent at 0.01 to 5 parts by weight, and boric acid at 0.02 to 5 parts by weight.

10. The firewall of claim 1, wherein the firewall comprises four or more consecutive layers of wallboard.

11. The firewall of claim 10, wherein plurality of the fasteners are located on opposite sides of the firewall and the plurality of fasteners penetrate through two or three layers of the wallboard.

12. An area separation wall comprising:

a pair of interior walls supported on framing and spaced from one another;

a firewall positioned within a space between the pair of interior walls, wherein the firewall comprises wallboard arranged in three or more layers and a plurality of fasteners affixing the three or more layers of the wallboard to one another, wherein each layer of the wallboard comprises gypsum, wherein each layer of the wallboard comprises a moisture resistant covering on an exterior surface thereof, and wherein at least one fastener of the plurality of fasteners is spaced at least 6" from horizontal edges of the wallboard and at least 6" from vertical edges of the wallboard; and clips affixing the firewall to the framing;

wherein the area separation wall satisfies the requirements for a 2-hour load bearing wall under ASTM E119 or UL 263.

13. The area separation wall of claim 12, wherein the pair of interior walls are spaced from the firewall by a distance of at least about 0.75 inches.

14. The area separation wall of claim 12, wherein each layer of the wallboard further comprises vermiculite and fiber glass.

15. The area separation wall of claim 12, wherein each layer of the wallboard comprises gypsum-containing stucco at 1300 to 1700 parts by weight, vermiculite at 25 to 65 parts by weight, and fiber glass at 3 to 16 parts by weight.

16. The area separation wall of claim 15, wherein each layer of the wallboard further comprises an adhesive at 6 to 25 parts by weight, a foaming agent at 0.01 to 5 parts by weight, and boric acid at 0.02 to 5 parts by weight.

* * * * *